US006792742B2

(12) United States Patent
Ekkert

(10) Patent No.: US 6,792,742 B2
(45) Date of Patent: Sep. 21, 2004

(54) METHOD FOR STORING AND/OR TRANSPORTING ITEMS

(75) Inventor: Leonard Ekkert, Lemont, IL (US)

(73) Assignee: Phoenix Closures, Inc., Naperville, IL (US)

( * ) Notice: Subject to any disclaimer, the term of this patent is extended or adjusted under 35 U.S.C. 154(b) by 0 days.

(21) Appl. No.: 10/237,483

(22) Filed: Sep. 9, 2002

(65) Prior Publication Data

US 2004/0045262 A1 Mar. 11, 2004

(51) Int. Cl.[7] ..... B65B 35/50; B65B 35/56; B65B 5/10

(52) U.S. Cl. ..... 53/447; 53/446; 53/475; 53/544; 53/542; 53/247

(58) Field of Search ..... 53/446, 447, 475, 53/544, 542, 247, 443

(56) References Cited

U.S. PATENT DOCUMENTS

| | | | | |
|---|---|---|---|---|
| 1,941,041 A | | 12/1933 | McKee | 206/65 |
| 2,215,705 A | | 9/1940 | Lenz | 206/46 |
| 2,268,245 A | | 12/1941 | Davis | 206/46 |
| 2,796,709 A | * | 6/1957 | Bolding | 53/398 |
| 3,061,092 A | | 10/1962 | Hime et al. | 206/79 |
| 4,313,539 A | | 2/1982 | Raines | 206/461 |
| 4,708,246 A | * | 11/1987 | Minion | 206/394 |
| 4,821,491 A | * | 4/1989 | Rias | 53/438 |
| 4,907,397 A | * | 3/1990 | Goodman | 53/443 |
| 5,394,986 A | | 3/1995 | Oya et al. | 206/445 |
| 6,085,910 A | | 7/2000 | Holmes | 206/830 |
| 6,122,896 A | * | 9/2000 | Weder et al. | 53/399 |

* cited by examiner

*Primary Examiner*—Stephen F. Gerrity
*Assistant Examiner*—Brian Nash
(74) *Attorney, Agent, or Firm*—Welsh & Katz, Ltd.

(57) ABSTRACT

The method stores and/or transports at least partially deformable items, such as caps for containers. One embodiment of the method has the following steps: identifying for at least one item an edge-on plane that is associated with a more deformable direction of the at least one item and an axial plane that is associate with a less deformable direction of the at least one item; and orienting the at least one item such that the edge-on plane of the at least one item is substantially vertical, the at least one item being stored and/or transported in an unsecured manner relative to other deformable items. This method therefore provides cost savings to both manufacturers and users by reducing the number of damaged and deformed items or caps during storage and/or transport.

7 Claims, 6 Drawing Sheets

METHOD FOR STORING AND/OR TRANSPORTING ITEMS

BACKGROUND

The field of the invention related to methods for storing and/or transporting at least partially deformable items, and in particular, to methods for storing and/or transporting caps or similar items for bottles, containers and the like.

Numerous types of caps such as screw-type caps are well known and are used in particular on glass or plastic beverage containers, medicine containers, etc. Such caps are also referred to as closure systems for bottles and containers that are produced in a variety of standard sizes and that are circulated in large numbers.

Injection molded caps for blow-molded bottles, medicine containers, etc. have been used for many years. Generally, two types of bottle caps are available, push-on caps and threaded caps. Push-on caps are installed by lining up the cap with the opening of a bottle and simply applying an axial force to the top of the cap. Thread-on caps generally require that the cap and bottle be aligned and that a rotational force be applied to the cap. In some cases, threaded caps may be made so that the rotational force required to install the cap is minimized or even eliminated. These kinds of injection-molded caps are often made with polypropylene, a common material used in injection molding. Many other types of plastic materials are also used for injection molding, polyethylene being the next most popular.

One form of screw type plastic bottle caps generally has a cap body with an internal thread and a tamperproof strip. Conventionally, the tamperproof strip is made so that it detaches at least partially from the cap body when the cap is unthreaded. This is intended as an indication to the person that the bottle or container was either previously opened, or has not yet been tampered with. Some caps must have pressure applied at certain locations in order to unscrew the cap from the container. Such caps are generally referred to as a childproof caps.

Typically injection molded caps are manufactured in large quantities which are temporarily stored until they are used for sealing respective containers. For example in the pharmacy field the caps may be shipped separate from the containers. When the pharmacist fills an order for a prescription, then a cap is used with a particular container. Thus there may be a significant amount of time between the manufacture of a cap and the actual use of the cap on a bottle or container. It has been a problem in the industry that when the time during which the caps are in storage, or in transport from one location to another, the caps may become deformed due to the weight of other caps that are stacked on top of them or due to environmental factors such as heat. One solution to this has been to ship cartons that are only half filed the caps. However, this approach is inefficient and costly. Thus there is a need for a cost effective method of efficiently transporting and storing such caps such that they do not become deformed or damaged prior to their use.

This drawback is overcome by one embodiment of a method for storing and/or transporting at least partially deformable items, such as the caps described above, which has the following steps: identifying for at least one item an edge-on plane that is associated with a more deformable direction of the at least one item and an axial plane that is associated with a less deformable direction of the at least one item; and orienting the at least one item such that the edge-on plane of the at least one item is substantially vertical. The at least one item is stored and/or transported in this edge-on orientation wherein the edge-on plane of the at least one item remains substantially vertical.

In a further embodiment of the method for storing and/or transporting at least partially deformable caps, each of a plurality of deformable caps is placed in an edge-on orientation. Thereafter each of the plurality of deformable caps is placed with the edge-on orientation in a container for storage therein and/or transport therein, each of the plurality of deformable caps being stored and/or transported in an unsecured manner relative to other deformable caps in the container.

While the present invention is susceptible of embodiments in various forms, there is shown in the drawings and will hereinafter be described some exemplary and non-limiting embodiments, with the understanding that the present disclosure is to be considered an exemplification of the invention and is not intended to limit the invention to the specific embodiments illustrated.

In the disclosure, the use of the disjunctive is intended to include the conjunctive. The use of the definite article or indefinite article is not intended to indicate cardinality. In particular, a reference to "the" object or "a" object is intended to denote also one of a possible plurality of such objects.

BRIEF DESCRIPTION OF THE DRAWINGS

The features of the present invention which are believed to be novel are set forth with particularity in the appended claims. The invention may best be understood by reference to the following description taken in conjunction with the accompanying drawings, in the several figures of which like reference numerals identify like elements, and in which:

DETAILED DESCRIPTION

Figure 1:
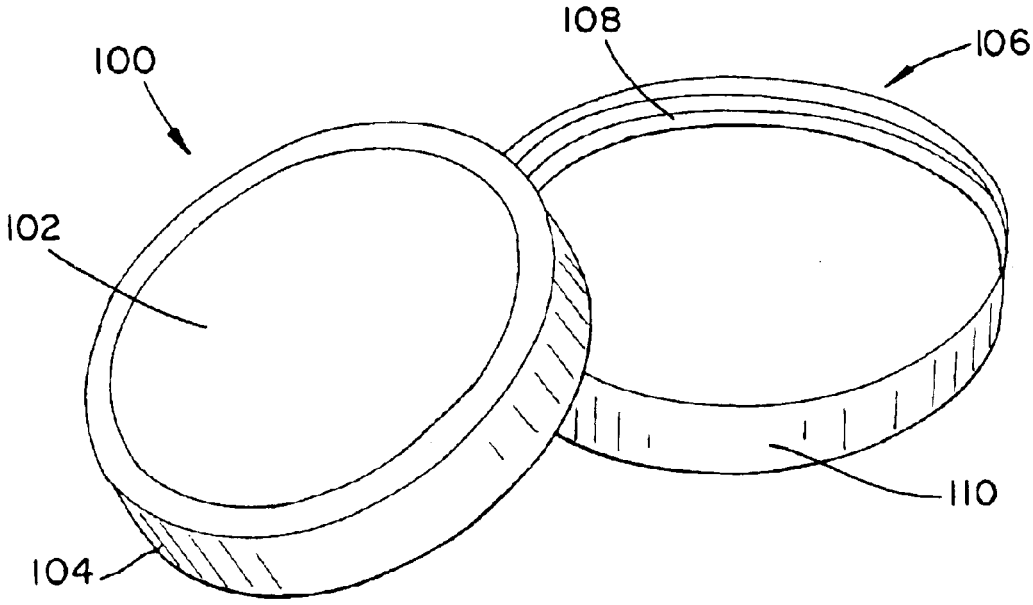
FIG. 1 is a perspective view of one embodiment of a cap for use with an embodiment of the present method of the subject invention.

Of the many different types of caps that are used for closing bottles and medical containers and other such items, the cap 100 in FIG. 1 is typical and just one example. The cap 100 has a front face 102 and an edge 104. The cap 106 also depicted in FIG. 1 has threads 108 on an interior side of the edge 110. These threads can have various forms as is known.

Figure 2:
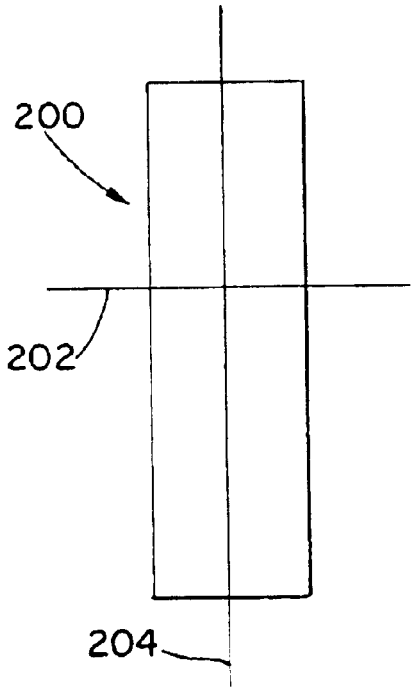
FIG. 2 is a side view of the cap of FIG. 1.
Figure 3:
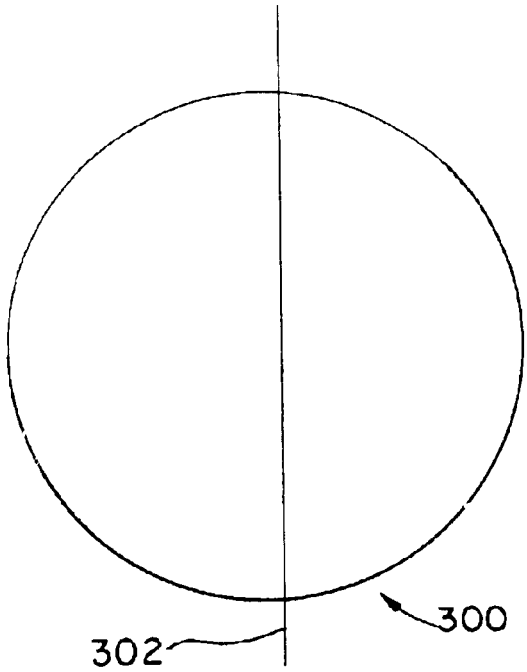
FIG. 3 is a view of the cap of FIG. 1.

It is to be understood that the present method is applicable to various types of different items of which the cap 100 and 106 in FIG. 1 are only one example. It is envisioned that the items may not even be caps, but may be other items such as emblems, coasters, etc. The present method is particularly useful with items that are at least partially deformable. Since of the item is only partially deformable, an edge-on plane can be defined and associated with the substantially non-deformable direction of the item. For example, shown in FIG. 2 is a cap 200 that has an axial plane 202 and an edge-on plane 204, the axial plane 202 and the edge-on plane 204 being substantially perpendicular to one another. The cap 200 is more deformable in the edge-on plane 204 than in the axial plane 202. FIG. 3 is a front view of a cap 300 showing the edge-on plane 302.

Figure 4:
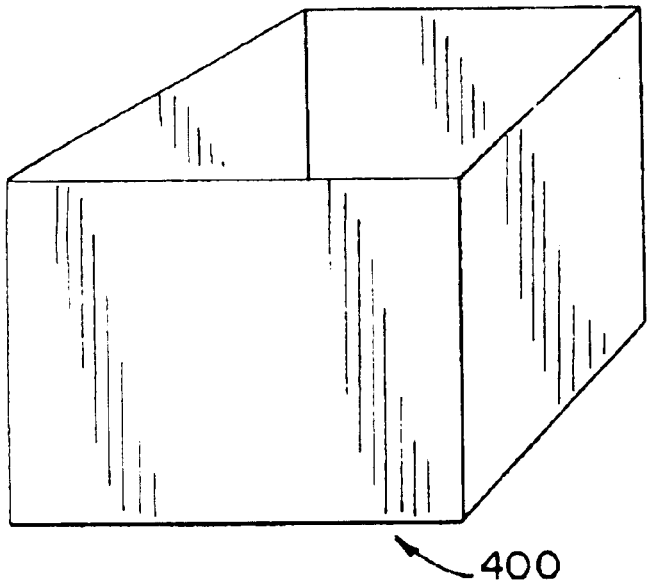
FIG. 4 is a perspective view of a container for use with an embodiment of the present method of the subject invention.
Figure 5:
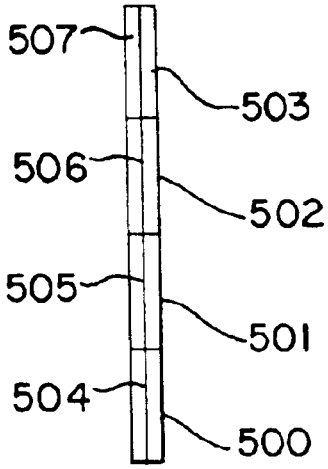
FIG. 5 is an illustration of caps stacked on edge according to the present method of the subject invention.

According to the present method, caps such as those depicted in FIGS. 1–3 are stored and/or transported in a container, such as container 400 depicted in FIG. 4. For example the container 400 may be a cardboard box. However, it is to be understood that the container 400 may be made of any type of material, such as fiberboard, plastic, metal, etc. Furthermore, the configuration may be other than rectangular or square as depicted in FIG. 4, and may be even circular, oval or any other type of configuration. However the configuration of the container 400 is such that the caps (such as those depicted in FIGS. 1–3) are stackable therein. According to one embodiment of the present method, the items or caps are oriented such that the edge-on plane of each of the items or caps is substantially vertical. As depicted in FIG. 5 several caps 500, 501, 502 and 503 are oriented such that each of their edge-on planes 504, 505, 506 and 507, respectively, are oriented vertically. It is to be understood that when an object is said to be oriented vertically it is oriented substantially vertically and need not be any perfect vertical direction. To be orientated vertically refers to being oriented in a direction in which the item or cap will not substantially deform while it is in storage or in transport along either axis, such as depicted in FIG. 5, where caps 500, 501, 502 and 503 are stacked edge-on.

Figure 6:
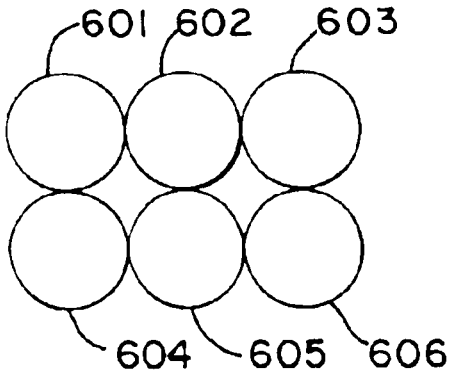
FIG. 6 is an embodiment showing a front view of the FIG. 5 stacked caps.
Figure 7:
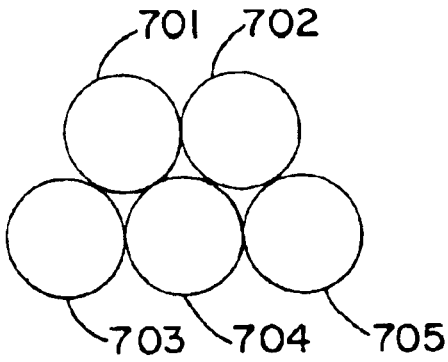
FIG. 7 is an embodiment showing in a front view an alternative arrangement of the FIG. 5 stacked caps.

When the caps are stacked in an edge-on orientation in a container, they may have various configurations such as depicted in a side view of FIGS. 6 and 7. FIG. 6 depicts caps 601–606 in a one configuration, while FIG. 7 depicts caps 701–705 in another configuration. In both configurations depicted in FIGS. 6 and 7 the caps are stacked in an edge-on direction such that they are stacked in the substantially less deformable direction. Furthermore, the caps are stored and/or transported in an unsecured manner relative to other deformable caps in the container. That is, the caps are not necessarily attached or secured to one another, although they may have an interlocking means if desired. In exemplary embodiments the caps are only substantially retained in their vertical orientation because they, for example, substantially fill the container. Thus, the caps are contained in the carton in an unsecured manner in the sense that no device or additional structure is required to keep the caps in the substantially vertical orientation.

Figure 8:
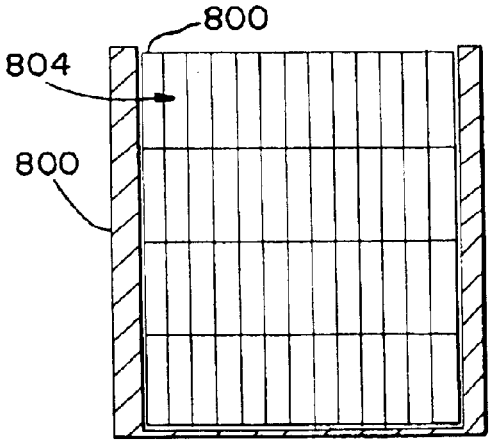
FIG. 8 is a cross sectional side view of the caps stacked in a container according to the present method of the subject invention.
Figure 9:
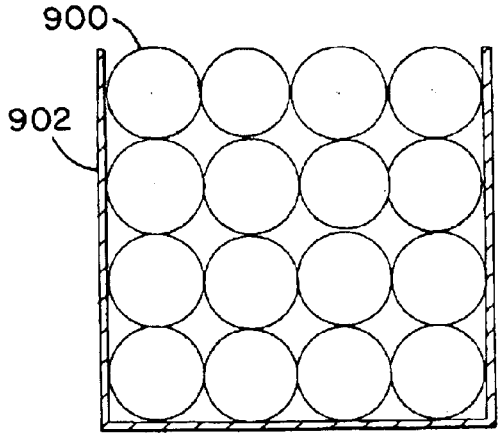
FIG. 9 is another cross sectional side view of the container of FIG. 8.

When the caps are placed in a container, the caps may be positioned in rows and layers as depicted in FIGS. 8 and 9, FIG. 8 being a first cross sectional side view and FIG. 9 being a second cross sectional side view of the caps. In FIG. 8 the caps 800 form rows 804 in a container 802. In FIG. 9 the caps 900 are shown in a layer in a container 902. Depending upon the number of caps and the size and configuration of the container, there may be one or more layers of caps and there may be one or more rows of caps.

Figure 10:
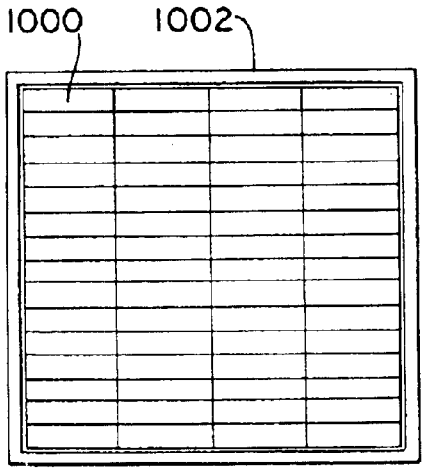
FIG. 10 is a view of caps stacked in a container of the FIG. 10 container.
Figure 11:
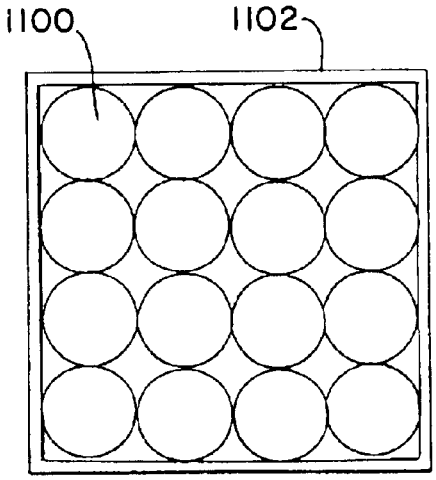
FIG. 11 is a top cross sectional side view of the container of FIG. 10.
Figure 12:
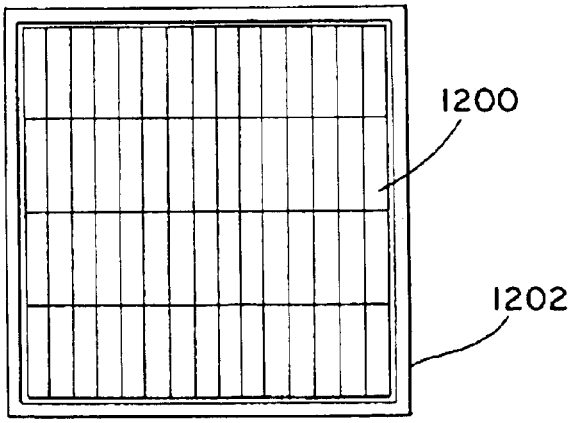
FIG. 12 is a cross sectional side view of the FIG. 10 container after it has been rotated according to the present method of the subject invention.

In a further embodiment of the present method caps 1000 may be stacked in a container 1002 in the orientation as depicted in FIG. 10, which is a view. FIG. 11 side view of caps 1100 similarly stacked in container 1102. According to an embodiment of the present method, after the caps are stacked in the container, the container is rotated until it is in the orientation depicted in FIG. 12 wherein the container 1202 contains stacked caps 1200 that are now oriented such that each of the caps 1200 has an edge-on plane in a substantially vertical orientation. That is, the caps 1200 are now stacked edge-on.

Figure 13:
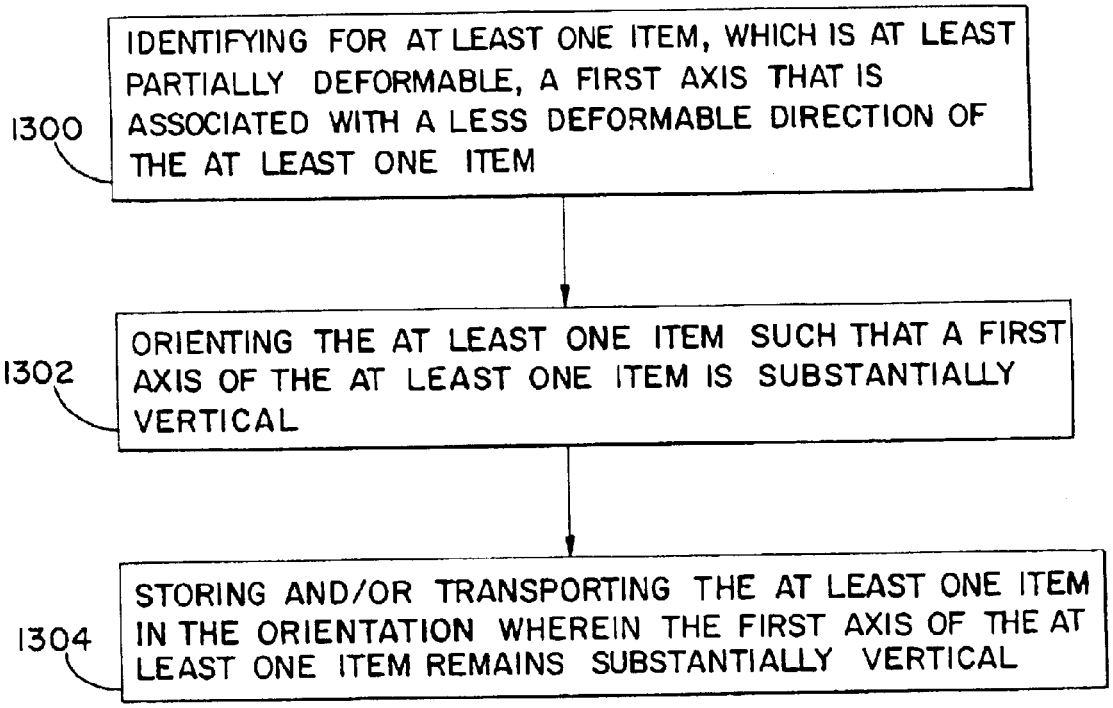
FIGS. 13–17 are flow diagrams depicting various embodiments of the present method for storing and/or transporting at least partially deformable items.

FIGS. 13–17 are flow charts depicting various embodiments of the present method for storing and/or transporting at least partially deformable items or caps. In FIG. 13 a method is set forth for storing and/or transporting at least partially deformable items in which an edge-on plane and an axial plane of at least one item are identified, the edge-on plane being associated with a substantially more deformable direction of the at least one item than the axial plane (step 1300). Thereafter, the at least one item is oriented such that the edge-on plane of the at least one item is substantially vertical (step 1302). The at least one item is stored and/or tansported in this orientation wherein the edge-on plane of the at least one item remains substantially vertical (step 1304).

Figure 14:
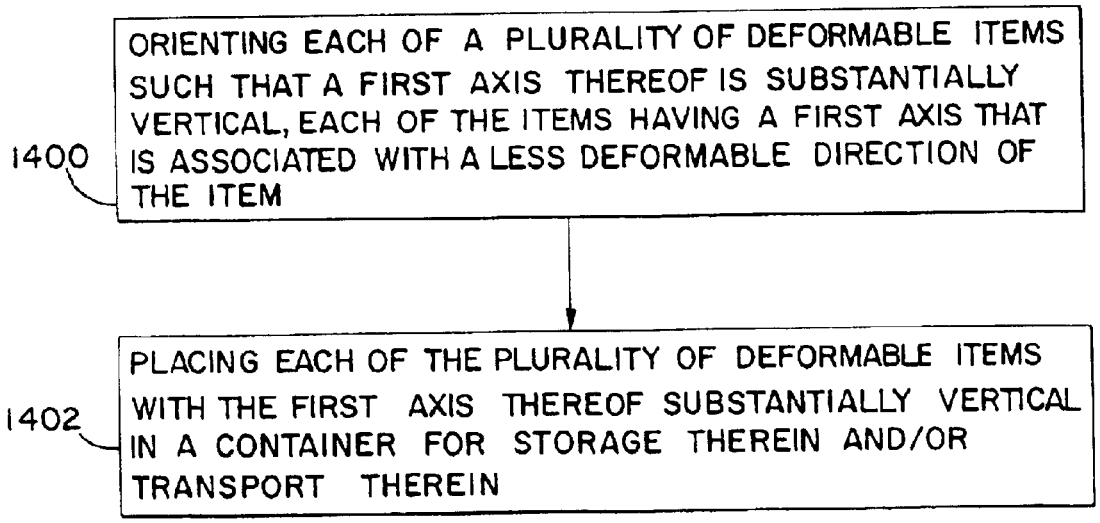

Another embodiment of the method is depicted in FIG. 14. Initially each of a plurality of deformable items is oriented such that an edge-on plane thereof is substantially vertical (step 1400). Thereafter, each of the plurality of the deformable items is placed with the edge-on plane thereof substantially vertical in a container for storage therein and/or transport therein (step 1402).

Figures 15, 16, 17:
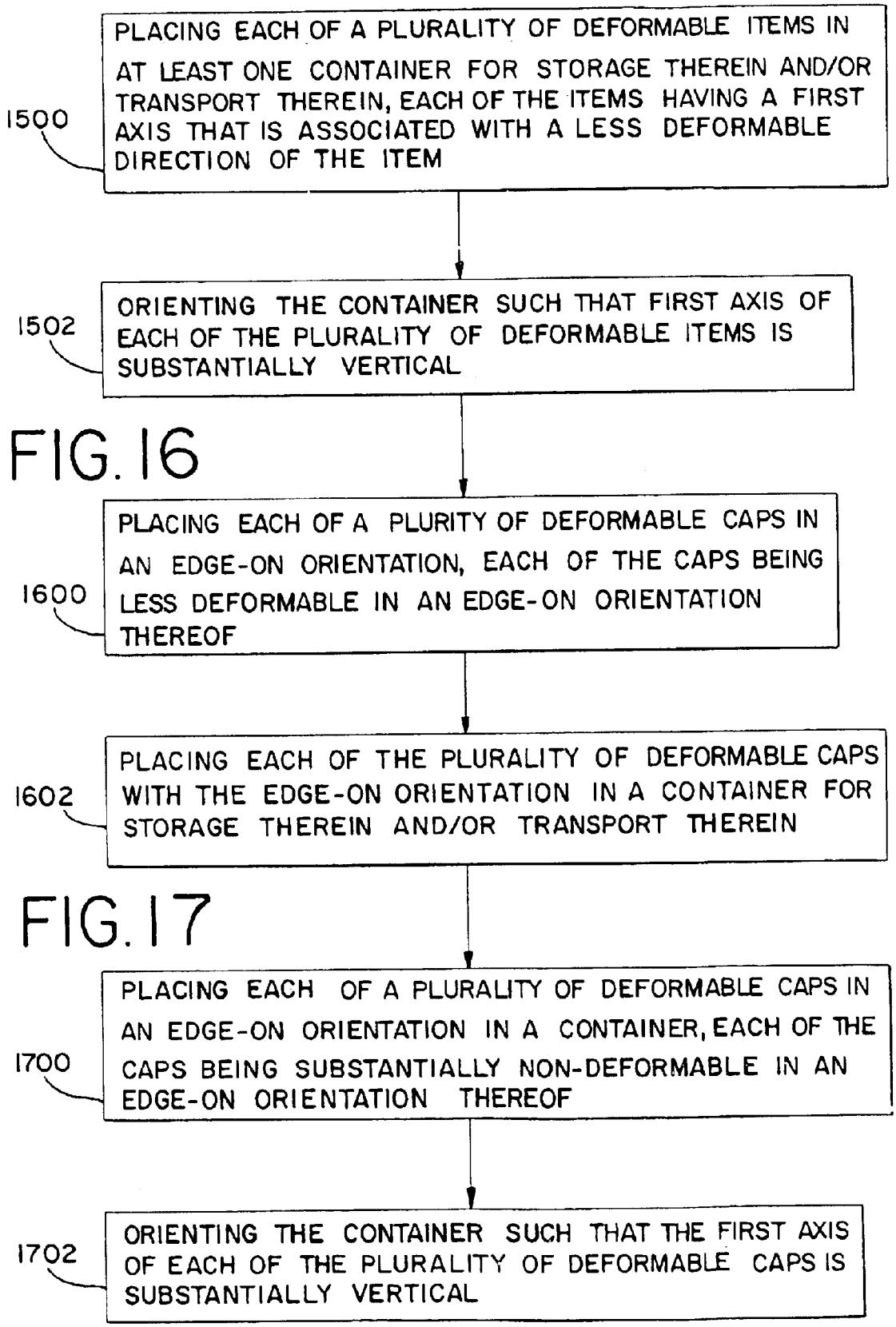

In yet another embodiment of the present method as depicted in FIG. 15 each of the items of a plurality of items has an edge-on plane associated with a deformable direction of an item. Each of the plurality of deformable items is placed in at least one container for storage therein and/or transport therein (step 1500). Thereafter, the container is oriented such that the edge-on plane of each of the plurality of the deformable items is substantially vertical (step 1502).

Figure 19:
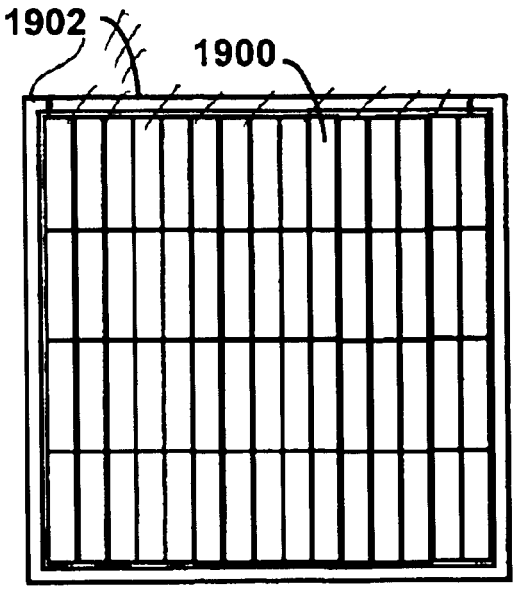
FIG. 19 is another cross sectional side view of the container of FIG. 18.
Figure 18:
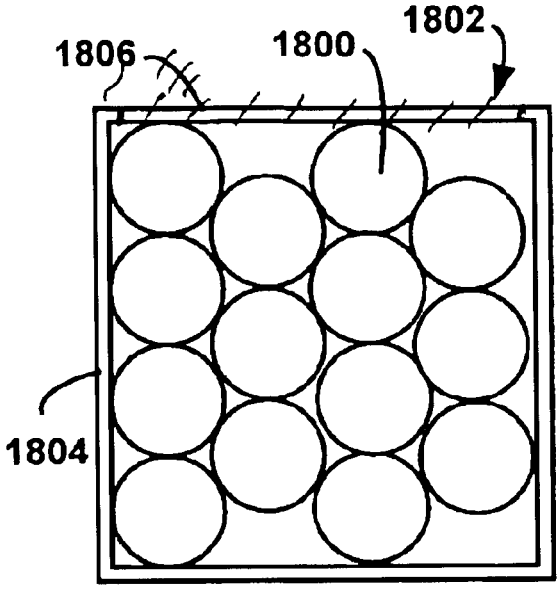
FIG. 18 is a cross sectional side view of caps stacked in a container according to a yet another embodiment of the method of the subject invention.
Figure 20:
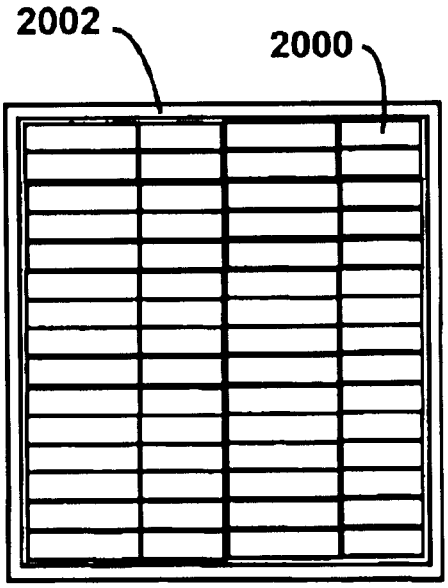
FIG. 20 is a top view of the container of FIG. 18.

In a further embodiment of the present method caps 1800 may be stacked in a container 1802 in the orientation as depicted in FIG. 18, which corresponds to the FIG. 7 arrangement of caps. FIG. 19 is a side view (side 1804 in FIG. 18) of caps 1900 similarly stacked in container 1902, and FIG. 20 is a top view (top 1806 in FIG. 18) of caps 2000 similarly stacked in container 2002.

In yet a further embodiment of the present method for storing and/or transporting at least partially deformable caps, each of the caps being less deformable in an edge-on orientation thereof, each of the plurality of deformable caps is placed in this edge-on orientation (step 1600). Thereafter, each of the plurality of the deformable caps is placed with the edge on orientation in a container for storage therein and/or transport therein (step 1602).

in yet another embodiment of the present method, each of a plurality of deformable caps is placed in an edge-on orientation in a container (step 1700). Thereafter, the container is oriented such that the edge-on plane of each of the plurality of deformable caps is substantially vertical (step 1702).

As described above the method further comprises positioning the caps in a plurality of rows, and further comprises distributing the plurality of rows in a plurality of layers (for example, see FIGS. 5–9).

The present method of the subject invention solves the problem of items, such as caps, becoming deformed during storage and/or transport thereof The present method therefore provides cost savings to both manufacturers and users by reducing the number of damaged and deformed caps during storage and/or transport. Furthermore, the present method allows for shipping cartons that are filled with caps filily minimizing airspace for example.

The present invention is not limited to their particular details of the method depicted, and other modifications and applications are contemplated. Certain other changes may be made in the above-described method without departing from the true spirit and scope of the invention herein involved. For example, the present method may be utilized with any type of item, which has different characteristics of deformability in different directions. It is intended, therefore, that the subject matter in the above depiction shall be interpreted as illustrative and not in a limiting sense.

What is claimed is:

1. A method for filling a carton with a plurality of closures, each of said closures having a top, a side wall, a deformable axis and a less deformable axis, comprising the steps of placing said plurality of closures into said carton to form a plurality of unsecured columns and rows, with the side wall of each of said closures generally adjacent one another, such that the deformable axis is vertical, and shipping and storing said carton such that said closures substantially remain with adjacent side walls and the deformable axis remains vertical.

2. The method according to claim 1, wherein each of said closures has an orientation depending on the direction of said side walls, and the step of placing a plurality of the closures into an unsecured column includes reversing the orientation of alternate closures.

3. The method according to claim 1, including substantially filling the carton with caps in a predetermined configuration.

4. The method according to claim 1, wherein the plurality of unsecured columns in the stacking arrangement are substantially integral with each other.

5. The method according to claim 1, including providing a carton that comprises a flat bottom four flat carton sides extending substantially perpendicularly from the bottom, and a flat carton top, which together form a rectangular prism.

6. The method according to claim 1, wherein the closures are partially deformable injection molded caps.

7. A method for filling a carton with a plurality of closures, each of said closures having a top, a side wall, a deformable axis and a less deformable axis, comprising the steps of placing said plurality of closures into said carton to form a plurality of unsecured columns and rows, with the side wall of each of said closures generally adjacent one another, such that the deformable axis is horizontal, manipulating said carton with said plurality of closures inside such that the deformable axis of said closures is oriented vertically and said closures remain with adjacent side walls when shipping and storing said carton.

* * * * *